United States Patent [19]

Rainwater

[11] 4,277,909

[45] Jul. 14, 1981

[54] TOY WITH STAGGERING MOTION

[76] Inventor: Richard C. Rainwater, Christian IV Gate 3, Stavanger, Norway

[21] Appl. No.: 72,940

[22] Filed: Sep. 6, 1979

Related U.S. Application Data

[63] Continuation-in-part of Ser. No. 935,765, Aug. 22, 1978, abandoned.

[30] Foreign Application Priority Data

May 16, 1978 [FR] France ..... 78 15003

[51] Int. Cl.[3] ..... A63H 11/10

[52] U.S. Cl. ..... 46/103; 46/206; 46/211

[58] Field of Search ..... 46/103, 104, 211, 156, 46/206, 97, 106, 123, 101, 107, 108

[56] References Cited

U.S. PATENT DOCUMENTS

| | | | |
|---|---|---|---|
| 368,499 | 8/1887 | Teichmann | 46/206 |
| 495,273 | 4/1893 | Schwabe | 46/201 |
| 1,210,992 | 1/1917 | Simon | 46/103 |
| 1,617,698 | 2/1927 | Allison | 46/102 |
| 1,681,666 | 8/1928 | Higgins | 46/211 X |
| 2,102,335 | 12/1937 | Richards | 46/104 |
| 2,533,906 | 12/1950 | Akers | 46/156 X |
| 2,942,376 | 6/1960 | Short | 46/104 |

FOREIGN PATENT DOCUMENTS

| | | | |
|---|---|---|---|
| 2509084 | 9/1975 | Fed. Rep. of Germany | 46/104 |
| 963570 | 7/1950 | France | 46/103 |
| 460088 | 10/1950 | Italy | 46/103 |
| 607851 | 9/1960 | Italy | 46/206 |
| 255450 | 1/1949 | Switzerland | 46/103 |
| 554382 | 7/1943 | United Kingdom | 46/219 |

OTHER PUBLICATIONS

"Cute Scoot", Wham-O Mfg. Co., 3/1965.

*Primary Examiner*—Gene Mancene
*Assistant Examiner*—Mickey Yu
*Attorney, Agent, or Firm*—Robert E. Burns; Emmanuel J. Lobato; Bruce L. Adams

[57] ABSTRACT

A moving toy comprises a foam plastic body, for example representing a mouse or rabbit, mounted on a U-shaped frame between the ends of which a weighted spool is rotatably mounted by means of a rubber band extending between the frame ends. A string wound on the spool extends out through a guide hole in the top of the body and is provided at its end with a hand grip. When the toy is released while holding the string, the toy drops to the floor whereby the unwinding string winds up the rubber band which thereupon rotates the spool to drive the toy. The ends of the spool are preferably eccentric so as to cause the toy to wobble.

8 Claims, 7 Drawing Figures

TOY WITH STAGGERING MOTION

REFERENCE TO PRIOR APPLICATION

This application is a continuation-in-part of my application Ser. No. 935,765 filed Aug. 22, 1978, now abandoned.

FIELD OF THE INVENTION

This invention relates in general to toys and has specific reference to a moving toy resembling an animal and to which a staggering motion is imparted, this toy comprising essentially a hollow body having an open bottom and containing a driving mechanism between its walls.

DESCRIPTION OF PRIOR ART

Clockwork toys are already known of which the driving mechanism comprises essentially a spring wound by means of a key. As long as driving power is delivered by the spring, the toy movement is regular and approaches reality if the toy resembles a mechanical object such as a train or car, but if the toy resembles an animal, for example a mouse or a rabbit, etc., this regular movement departs from reality.

It is also know to provide toys with a driving mechanism in the form of wheels or a spool which is driven by a rubber band which is wound up by pushing the toy along the floor or by pulling on a string.

SUMMARY OF THE INVENTION

It is an object of the present invention to provide a toy that can be made very easily at low cost and is safe and entertaining for use by children.

In accordance with the invention the toy comprises a downwardly opening U-shaped frame and a hollow body of cellular plastic material which is mounted on the frame and open at its bottom. The bottom extends somewhat below the frame. A spool is rotatably supported by a rubber band which extends between the lower ends of the frame and through an axial hole in the spool. Midway of its length the spool is secured to the band so that the band is twisted by rotation of the spool. A string wound around the spool extends up through a hole in the top of the body and is provided with a finger grip at its end. In use, the toy is held above the floor and released while the finger grip on the end of the string is held. The toy drops to the floor and the string in unwinding from the spool rotates the spool so as to wind up the rubber band. When the toy reaches the floor and the string is released, the rubber band rotates the spool in the opposite direction so as to propel the toy along the floor.

By reason of its simple construction, the toy can be manufactured easily and economically. As the body of the toy is soft foam plastic, the toy cannot damage any furniture into which it bumps and is completely safe for even a small child to use. The spool has end flanges which are eccentric to the axis of the spool so that the toy runs along the floor with a staggering motion which is lifelike and attractive.

A clearer understanding of the invention will be had if reference is made to the accompanying drawings illustrating diagrammatically typical forms of embodiment thereof.

DESCRIPTION OF THE PREFERRED EMBODIMENT

Figure 1:
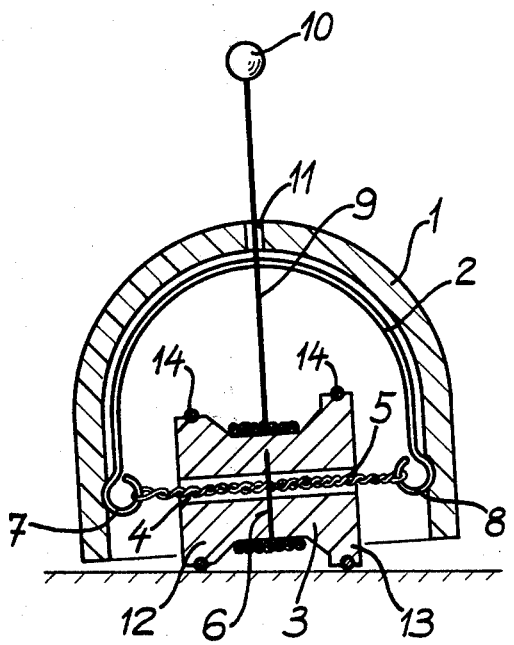
FIG. 1 is a cross-sectional and elevational view of the toy according to this invention.
Figure 2:
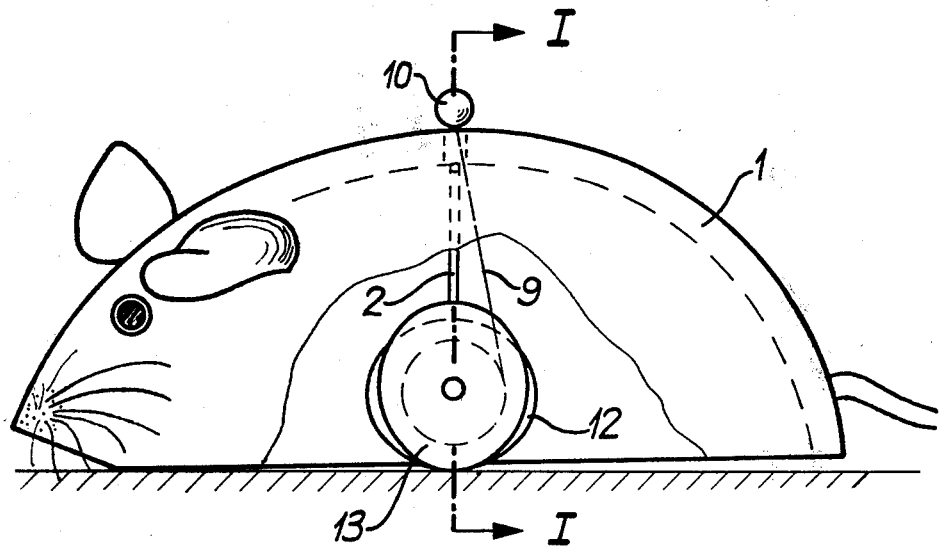
FIG. 2 is a side elevational view of the toy of FIG. 1, with parts broken away to show the driving mechanism.

Referring first to FIGS. 1 and 2, the toy according to this invention illustrated therein roughly resembles a mouse and comprises a hollow body 1 of suitable soft plastic material such as expanded or cellular polyethylene mounted on a rigid, U-shaped frame 2 for example of metal wire. A spool 3 is mounted for free rotation between the lateral walls of the body 1 and projects slightly from beneath the open bottom of this body 1. The spool 3 comprises a longitudinal central bore 4 through which an elastic element 5 is passed and acts both as a shaft and as a return member for the spool 3. At its midpoint this elastic element 5 is secured through any suitable means, such as a cross pin or nail 6, to the spool 3 and has its opposite ends anchored to corresponding loops 7 and 8 formed at the lower ends of said frame 2. A string 9 attached at one end to the spool 3 is wound around the latter and its opposite end, provided with a finger grip in the form of a stop member 10, extends through a hole 11 formed at the top of the body 1 and can thus be pulled from the outside of said body 1. The spool 3 is provided with a pair of integral end flanges 12, 13 of which the peripheries are located at irregular distances from the axis of rotation of the spool 3. In the form of embodiment illustrated, the peripheries of the flanges 12, 13 have an elliptical configuration, the major axes of the two ellipses being shifted from each other by 90° so that when the spool bears on a substantially flat surface the rotation of the spool on this surface propels the toy with a staggering motion.

To operate the toy, the user simply pulls the string 9 away from the body 1, thus causing the string to unwind from and rotate the spool 3, so that the elastic element 5 is twisted and caused to store energy.

If, after laying to the toy on the floor, the user releases the traction exerted on the string 9, the spool 3 will be rotatably driven in the opposite direction by the elastic force stored in the elastic element 5. As explained hereinabove, the forward motion of the toy is then a staggering one, since the toy bears on the floor through points consisting on the one hand of the peripheries of the two spool flanges and on the other hand of the body proper tending to cant now on one side, now on the other side.

Figure 3:
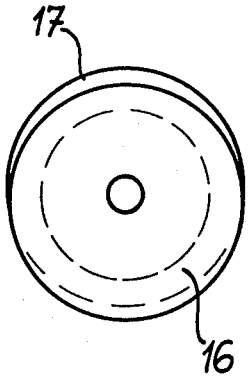
FIGS. 3 and 4 are a side elevational view and a front view, respectively of a second form of embodiment of the driving spool.
Figure 4:
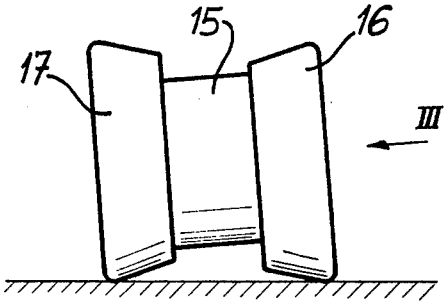

Of course, other means may be provided for producing this staggering motion. Thus, for example and as shown in FIGS. 3 and 4, the spool 15 may have its end flanges made of circular "wheels" having their axes disposed eccentrically in relation to the spool axis. It is also possible to provide only one eccentric wheel (with respect to the spool axis), the other wheel being concentric thereto. Another possibility consists in providing flanges having any polygonal convex configuration, or curvilinear polygonal configuration, the only requirement being that the outer peripheries of the two flanges must not be symmetrical to each other. As in the example illustrated in FIGS. 5 and 6, the flanges 18, 19 consist of hexagonal elements so mounted on the spool 20 that the each vertex 21 of one flange 18 lies between two adjacent vertices 22 of the other flange 19, so that the points through which the toy bears on the floor are, in addition to the bottom of the body proper, one vertex 21 (or 22) of one of the flanges 18 (or 19) and a flat face 23 (or 24) of the other flange 19 (or 18).

Figure 7:
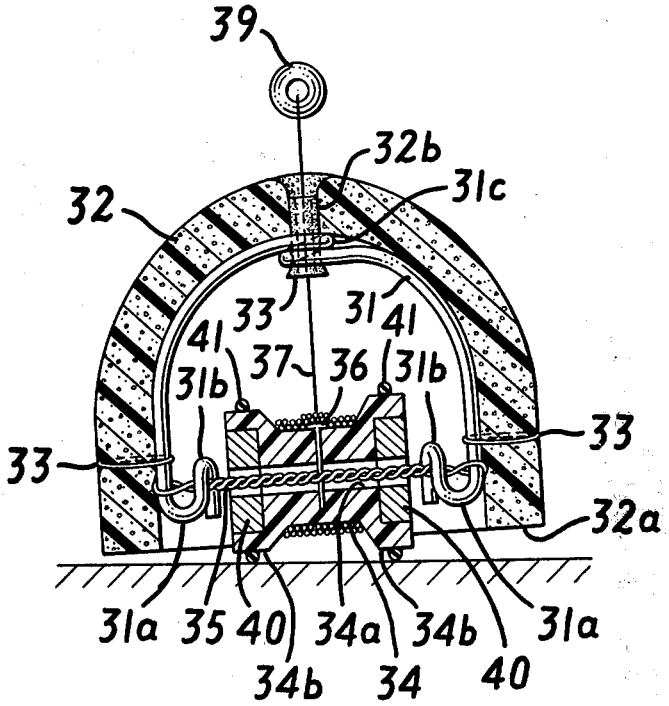
FIG. 7 is a cross sectional view similar to FIG. 1 but showing modifications.

In FIG. 7 there is shown a modification of the invention in which the toy comprises a U-shaped wire frame 31 on which a hollow soft plastic body 32 of inverted U-shaped transverse cross section is mounted. The body 32 is formed from a cellular plastic material which is preferably about one centimeter thick and is soft and pliable but has sufficient body to retain its shape. The body 32 has a skirt portion which extends down below the lower end of the frame 31 and terminates in a lower edge 32*a* at least portions of which are engageable with the floor. The center of gravity of the body is such that a forward portion normally engages the floor as illustrated in FIG. 2. The body is suitably secured to the flame, for example by tie threads 33 which extend through the body and around the frame. The tie threads 33 are located above the lower ends of the frame 31 so as to leave lower ends free.

A spool 34 is rotatably supported between lower ends of the frame by means of a rubber band 35 which extends between free lower end portions of the frame. At its lower ends the wire forming the frame 31 is bent inwardly as indicated at 31*a* and the end portion is then bent to form an approximately circular eye or loop 31*b*. Opposite ends of the rubber band 35 extend through the eyes 31*b* and around lower end portions of the frame so as to be securely anchored. At its central point the rubber band 35 is secured to the spool 34 by a pin 36 which extends into the spool and across the axial bore 34*a* so as to capture the rubber band at its midpoint. The pin 36 is preferably removable so as to permit replacement of the rubber band 35 in the event that it breaks. The rubber band 35 is preferably in the form of an elongated loop so that a double strand extends through the axial bore 34*a* of the spool. The pin 36 passes between the two strands so that when the spool is rotated the strands of the rubber band are twisted on one another. The rubber band 35 serves as an axle to support the spool for rotation and upon being twisted tends to rotate the spool in the opposite direction and thus provides power for driving the spool.

A string 37 has one end secured to the spool and is wound around a central portion of the spool in a multiplicity of turns. The other end of the string extends out through a grommet 38 which is held in an eye formed by a loop 31*c* in the central part of the frame wire 31 and extends up through a hole 32*b* in the body 32. A finger grip shown in the form of a ring 39 is attached to the outer end of the string 37. The ring 38 also acts as a stop which prevents the end of the string escaping down through the grommet 38.

Figure 5:
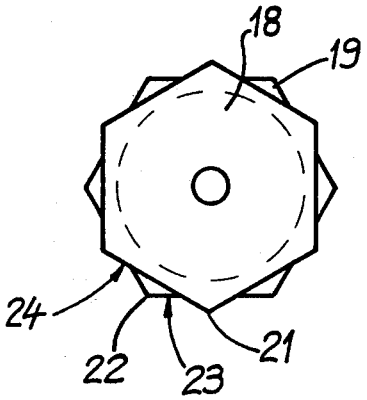
FIGS. 5 and 6 are similar views of a third form of embodiment of the spool.
Figure 6:
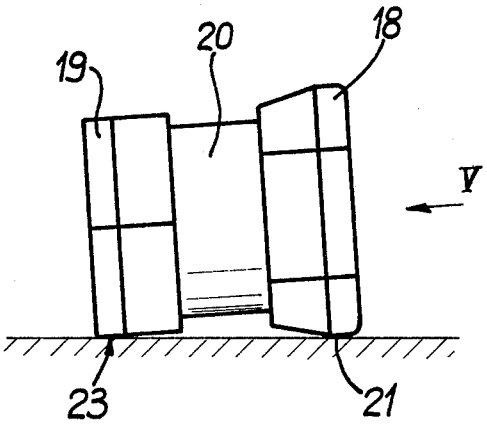

Except as otherwise described, the toy shown in FIG. 5 is like that of FIGS. 1 and 2 and operates in the same manner.

The body 32 being formed of cellular or spongelike material is of light weight. The frame 31 is also light being formed of a single piece of wire. The spool 34 on the other hand is relatively heavy. For example it is formed of metal or dense plastic material. Alternatively the spool 34 may be molded of plastic with metal inserts 40 for example of steel, copper or lead embedded in opposite ends of the spool. The spool is thus the heaviest part of the toy being heavier than the combined weight of the body and frame. By having the spool heavy, the center of gravity of the toy is kept low so that it does not readily upset. Moreover, the spool is sufficiently heavy that if the toy is held above the floor and then released while holding the finger grip 39 on the end of the string 37, the toy will drop to the floor by its own weight and the spool 34 is rotated by unwinding of the string 37 so as to twist the rubber band 35. When the string is then released, the rubber band unwinds so as to propel the toy along the floor. The weight of the spool also increases its rotary inertia and thereby improves the performance of the toy. As in the embodiment illustrated in FIGS. 1 and 2, a central portion of the spool on which the string is wound is concentric with the bore 34*a* while flanges 34*b* at opposite ends of the spool are elliptical or eccentric so as to cause the toy to move with a wobbling motion. Rubber rings 31 on the flanges 34*b* act as tires so that the toy will operate even on a smooth surface.

While preferred embodiments of the invention have been illustrated in the drawings and are herein particularly described, it will be understood that many modifications can be made and that the invention is thus in no way limited to the illustrated embodiments.

What is claimed is:

1. A toy comprising a vertically disposed, transverse, downwardly opening inverted U-shaped rigid frame having an eye in its central upper portion, a hollow body of soft cellular plastic material mounted on said frame and having a hole registering with said eye, said body being of inverted U-shaped transverse cross section conforming to said frame and being open at its bottom with a skirt portion extending down below said frame, said frame being disposed transversely of said body approximately midway between forward and rear ends of said body and conforming to a median transverse cross section of said body, means securing said body to said frame above the lower ends of said frame while leaving lower ends of said frame free of said body, a rubber band extending between the free lower ends of said frame, a spool having an axial bore through which said rubber band extends whereby said spool is rotatably supported by said rubber band, a string wound around said spool and extending up through said eye of said frame and registering hole in said body and a finger grip on said string above said body, whereby if said toy is held above the floor and released while the finger grip is held, the toy drops to the floor and the string in unwinding from said spool rotates said spool to wind-up said rubber band which thereupon rotates the spool in the opposite direction to propel the toy along the floor.

2. A toy according to claim 1, in which said spool is heavier than said body.

3. A toy according to claim 2, in which said spool is of plastic material with metal inserts to increase its weight.

4. A toy according to claim 1, in which said frame comprises a wire bent to U-form and bent to provide at its lower ends eyes for attachment of opposite ends of said rubber band.

5. A toy according to claim 4, in which a central portion of said wire is bent to form a loop having an approximately vertical axis and constituting said central eye through which said string extends.

6. A toy according to claim 1, in which a grommet is fixed in said central eye of said frame and extends into said registering hole in said body, said string passing through said grommet.

7. A toy according to claim 1, in which said frame has rounded lower ends.

8. A toy according to claim 1, in which said body portion simulates in appearance a mouse.

* * * * *